United States Patent [19]

Doiron

[11] 4,249,434

[45] Feb. 10, 1981

[54] HACKLE CLAMP

[76] Inventor: Joseph Doiron, c/o J. D. Flytying Tool Co., 27544 Seco Cyn. Rd., Saugus, Calif. 91350

[21] Appl. No.: 46,458

[22] Filed: Jun. 7, 1979

[51] Int. Cl.[3] ..... B25B 9/02

[52] U.S. Cl. ..... 81/43; 81/302

[58] Field of Search ..... 81/43, 302; 128/354; 294/99, 99 S

[56] References Cited

U.S. PATENT DOCUMENTS

| | | | |
|---|---|---|---|
| 759,668 | 5/1904 | Carlsen | 81/43 |
| 1,169,955 | 2/1916 | Hammond | 81/302 |
| 1,521,689 | 1/1925 | King | 81/43 |
| 3,971,270 | 7/1976 | Wallace | 81/43 |

*Primary Examiner*—Othell M. Simpson

*Attorney, Agent, or Firm*—Charles R. Fay

[57] ABSTRACT

An effective and inexpensive hackle clamp comprising a loop of flat spring wire having free ends extending from the loop, the free ends being flatly fastened together inwardly from the terminal ends thereof forming a clamp which is easily opened by squeezing the sides of the flat wire in the loop area.

1 Claim, 5 Drawing Figures

HACKLE CLAMP

BACKGROUND OF THE INVENTION

Many hackle clamps (pliers) are on the market, but the feather is very apt to pull out of those available; when winding on a hackle, it is necessary to keep tension on the feather. The most common commercial clamp comprises a length of resilient wire wound on itself to form a spring and having two parallel bent ends overlapped between which the hackle is grasped. It has been found that this type of hackle clamp does not ordinarily hold the hackle with the force required by an experienced fly tyer and it is, of course, annoying to lose the grip on the hackle midway through winding it on. It is the purpose of the present invention to provide an inexpensive but efficient hackle clamp which firmly holds the hackle end and does not release it under any accidental circumstance.

SUMMARY OF THE INVENTION

The present invention comprises a length of resilient flat wire formed in a loop and having a pair of flat parallel free ends riveted together inwardly of said ends, to form a very firm positive clamp, which, however, is easily opened by squeezing the loop in the area between the permanent fastener and the opposite end of the loop.

PREFERRED EMBODIMENT OF THE INVENTION

Figure 1:
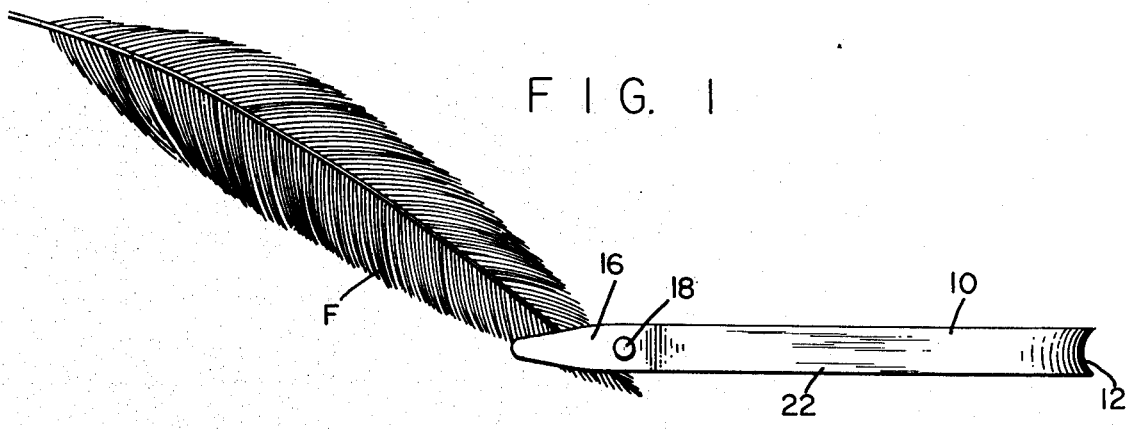
FIG. 1 is a view in elevation illustrating the new hackle clamp.
Figure 2:
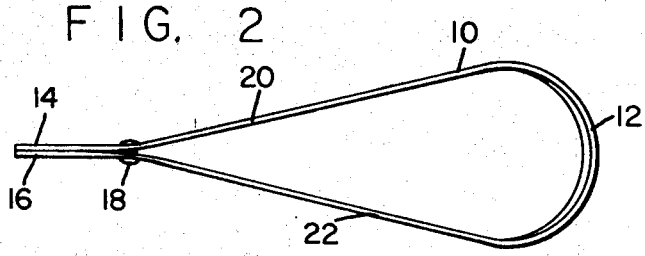
FIG. 2 is a plan view thereof showing the hackle clamp closed.

A straight length of flat spring wire is formed into a loop indicated at 10. This loop has a rounded portion 12 and at the distal end thereof the ends indicated at 14 and 16 are permanently positioned flatwise in gripping contact, see FIG. 2, by means of a rivet or other fastener 18.

Figure 3:
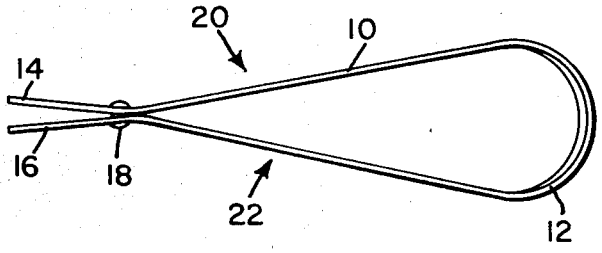
FIG. 3 is a view similar to FIG. 2 showing the hackle clamp open.
Figure 5:
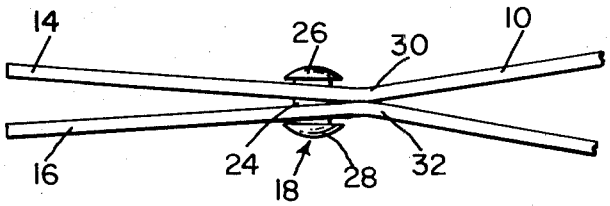
FIG. 5 is a similar view showing the same open.

By squeezing the loop in the area at 20,22 the two clamping end portions 14,16 automatically open up, see FIGS. 3 and 5, and the feather may be inserted, whereupon it is firmly grasped merely by releasing the pressure on the loop. Thereafter the hackle may be used in the manner of any hackle clamp but having a much firmer grasp by means of the ends 14,16, than any hackle clamp so far known.

Figure 4:
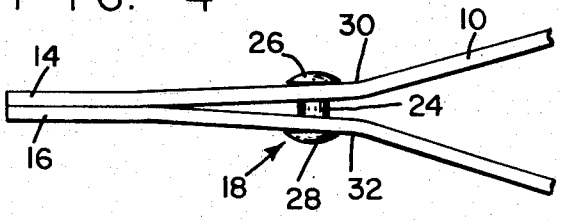
FIG. 4 is an enlarged view illustrating the clamping ends of the hackle clamp in clamping relationship.

The rivet 18 comprises a shank 24 and the head 26,28, see FIGS. 4 and 5. The heads are spaced apart a distance greater than the combined thickness of the two clamping loop ends 14,16, so that the resilience of the clamp material insures a very tight grip on the feather. In clamping relation, the flat wire parts at 30,32 are separated slightly. When pressure is applied as above-described in the areas at 20,22, the flat wire parts contact each other and this causes them to act like a fulcrum, opening the clamping wire ends 14 and 16, see FIG. 5.

I claim:

1. A fly tyer's hackle clamp comprising a length of spring wire in the form of a simple loop having the ends thereof in close juxtaposition and flatly contacting each other in clamping relationship, a rivet holding the wire in the form of a loop and also holding the clamping ends generally flatwise together in clamping relation, said rivet being located inwardly of the terminal ends of the clamping ends, the rivet having an unimpeded shank longer than the combined thicknesses of the two clamping ends and a head at each end of the shank holding the spring wire material out of contacting relation at said rivet, the spring wire material being in contacting relation at the side of the rivet opposite the clamping ends when lateral inward pressure is applied to the loop, the point of contact forming a fulcrum to force the clamping ends apart.

* * * * *